US006772606B2

(12) United States Patent
Kopf et al.

(10) Patent No.: US 6,772,606 B2
(45) Date of Patent: Aug. 10, 2004

(54) METHOD AND APPARATUS FOR A PLASTIC EVAPORATOR FAN SHROUD ASSEMBLY

(75) Inventors: Bruce A. Kopf, Cedar Rapids, IA (US); Tim L. Coulter, Cedar Rapids, IA (US); Richard A. Kirchner, Cedar Rapids, IA (US); Michael A. Bowen, Keystone, IA (US); Troy M. Anderson, Marion, IA (US); Eric K. Silbaugh, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/195,174

(22) Filed: Jul. 15, 2002

(65) Prior Publication Data

US 2004/0007010 A1 Jan. 15, 2004

(51) Int. Cl.[7] ..... F25D 17/06; F25D 19/00
(52) U.S. Cl. ..... 62/419; 62/455; 415/220
(58) Field of Search ..... 62/419; 415/220

(56) References Cited

U.S. PATENT DOCUMENTS

| | | | | | |
|---|---|---|---|---|---|
| 3,508,729 | A | * | 4/1970 | Wilson | 248/604 |
| 3,620,644 | A | * | 11/1971 | McLarty | 416/97 R |
| 3,793,847 | A | * | 2/1974 | Scarlett et al. | 62/190 |
| 3,992,171 | A | | 11/1976 | Jenewein | |
| 4,155,528 | A | * | 5/1979 | Dawson | 248/674 |
| 4,293,114 | A | * | 10/1981 | Lykes | 248/604 |
| 4,335,646 | A | * | 6/1982 | Jacquet et al. | 454/159 |
| 4,800,734 | A | * | 1/1989 | Sauber et al. | 62/263 |
| 4,927,328 | A | | 5/1990 | Scoates et al. | |
| 5,133,617 | A | * | 7/1992 | Sokn et al. | 403/349 |
| 5,244,347 | A | | 9/1993 | Gallivan et al. | |
| 5,245,236 | A | | 9/1993 | Horng | |
| 5,342,167 | A | | 8/1994 | Rosseau | |
| 5,478,201 | A | * | 12/1995 | Amr | 415/206 |
| 5,533,862 | A | | 7/1996 | Jung | |
| 5,951,247 | A | * | 9/1999 | Rockwell et al. | 415/208.3 |
| 6,133,666 | A | | 10/2000 | Hollenbeck et al. | |
| 6,170,275 | B1 | | 1/2001 | Ueno et al. | |
| 6,232,687 | B1 | | 5/2001 | Hollenbeck et al. | |

FOREIGN PATENT DOCUMENTS

| | | |
|---|---|---|
| FR | 2 539 930 | 7/1984 |

* cited by examiner

*Primary Examiner*—William C. Doerrler
*Assistant Examiner*—Filip Zec
(74) *Attorney, Agent, or Firm*—McKee, Voorhees & Sease, P.L.C.

(57) ABSTRACT

An evaporator fan assembly includes a shroud have a plurality of irregularly staggered shroud legs radially outwardly spaced from a fan orifice and terminating in a motor mount. A motor is removably secured to the motor mount by a motor clip. The motor clip preferably includes a pair of legs terminating in a catch or hook that may be secured to a cross-member or support bar between the shroud legs. The motor is secured in a centered position to properly align a fan blade in the fan orifice. The fan blade is secured to the drive shaft of the motor which passes through a hole in the motor mount. A shroud cover may be secured to the shroud.

16 Claims, 8 Drawing Sheets

METHOD AND APPARATUS FOR A PLASTIC EVAPORATOR FAN SHROUD ASSEMBLY

FIELD OF THE INVENTION

The present invention relates generally to evaporator fans for refrigerator/freezers and more particularly, though not exclusively, to a plastic evaporator fan assembly.

BACKGROUND OF THE INVENTION

An evaporator fan assembly has conventionally been provided in an evaporator compartment of a household refrigerator/freezer for circulating cooling air through storage compartments. The fans generally comprise an electric motor operatively connected to a fan in a shroud assembly containing both. Refrigerator/freezers are generally household appliances, and it is therefore desirable to keep noise levels to a minimum. During operation of typical evaporator fans, turbulence may cause noise levels to increase. U.S. Pat. No. 5,244,347 issued to Gallivan on Sep. 14, 1993, discusses arranging motor support members in a non-radial arrangement to minimize a creation of turbulence by the operation of the fan and thereby minimize noise levels. However, the fan disclosed in Gallivan must be preassembled, increasing its costs. Further, if any repairs are required, the entire assembly must be removed and replaced. It is therefore desirable to provide an evaporator fan assembly that is both easy to install and repair.

As Gallivan illustrates, it is typical to integrally secure the motor to the fan assembly. However, recent attempts have been made to removably secure the motor to the fan assembly such that installation and repair can be simplified. One such attempt, shown in U.S. Pat. No. 6,232,687 issued to Hollenbeck on May 5, 2001, shows a motor that includes a snap-connection to the fan assembly. However, the motor of Hollenbeck is secured within the fan orifice and therefore minimizes fan effectiveness. It is therefore desirable to provide a fan motor that is easy to install while maximizing fan effectiveness.

Accordingly, a primary feature of the present invention is the provision of an evaporator fan assembly and method for installing the same in a refrigeration unit that overcomes problems found in the prior art.

Another feature of the present invention is the provision of an evaporator fan assembly and method for installing same that simplifies installation and assembly.

A further feature of the present invention is the provision of an evaporator fan assembly and method for installing same that maximizes the effectiveness of the evaporator fan.

A still further feature of the present invention is the provision of an evaporator fan assembly and method for installing same that minimizes the noise level of the evaporator fan.

These and other features and advantages of the present invention will become apparent from the following specification and claims.

BRIEF SUMMARY OF THE INVENTION

The present invention generally comprises an evaporator fan assembly including a shroud having a fan orifice and a plurality of legs that are irregularly staggered and radially spaced outwardly around the fan orifice with a motor removably mounted thereon. Preferably, the shroud legs extend away from the fan orifice and are connected to one another by a motor mount. The motor mount generally includes a hole through which the drive shaft of the motor may be inserted.

The motor is preferably mounted away from the fan orifice in a manner that allows the user to simply snap fit the motor to the shroud. Preferably, the motor is mounted by using a motor clip. The motor clip includes a pair of legs each terminating in a hook or catch secured to one or more of the shroud legs by a cross member or support bar. The tension inherent in the motor clip keeps the hooks or catches in a locked position.

After the motor has been secured to the motor mount and the shroud legs by the motor clip, a fan having a plurality of blades is secured to the drive shaft. In this manner, the evaporator fan assembly of the present invention allows the evaporator fan to operate with minimal interference from the evaporator fan motor. Further, during operation, the irregularly staggered and radially outwardly spaced arrangement of the legs minimizes the build-up of turbulence and therefore keeps noise levels of the evaporator fan assembly to a minimum.

DETAILED DESCRIPTION OF THE PRESENT INVENTION

The present invention will be described as it applies to its preferred embodiment. It is not intended that the present invention be limited to a preferred embodiment. It is intended that the invention cover all modifications and alternatives that may be included within the spirit and scope of the present invention which is to be limited only by the claims appended hereto.

Figure 1:
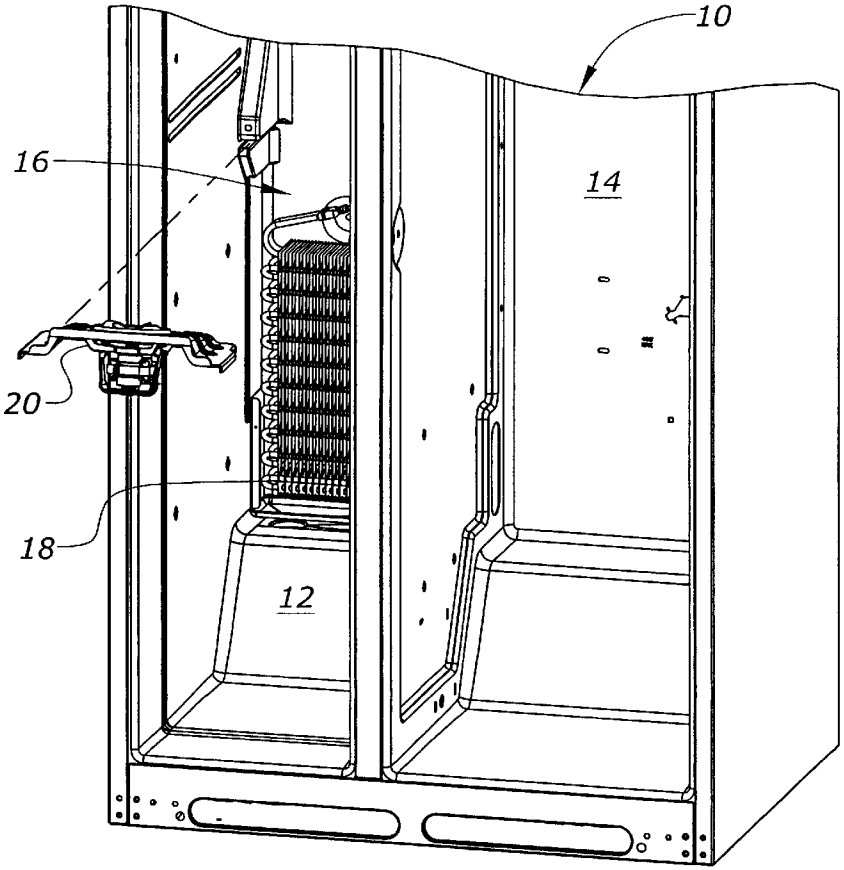
FIG. 1 is a sectional view of a typical side by side refrigerator/freezer unit incorporating the present invention.

The present invention generally relates to an evaporator fan assembly typically installed in a refrigerator/freezer household appliance. As shown in FIG. 1, a side by side refrigerator/freezer unit 10 is shown with the doors and interior appointments removed. Generally, a refrigerator/freezer unit 10 will include a freezer assembly 12 and a refrigeration assembly 14. In the freezer assembly 12, an evaporator compartment 16 contains an evaporator 18 and the evaporator fan assembly 20 of the present invention.

Figure 2:
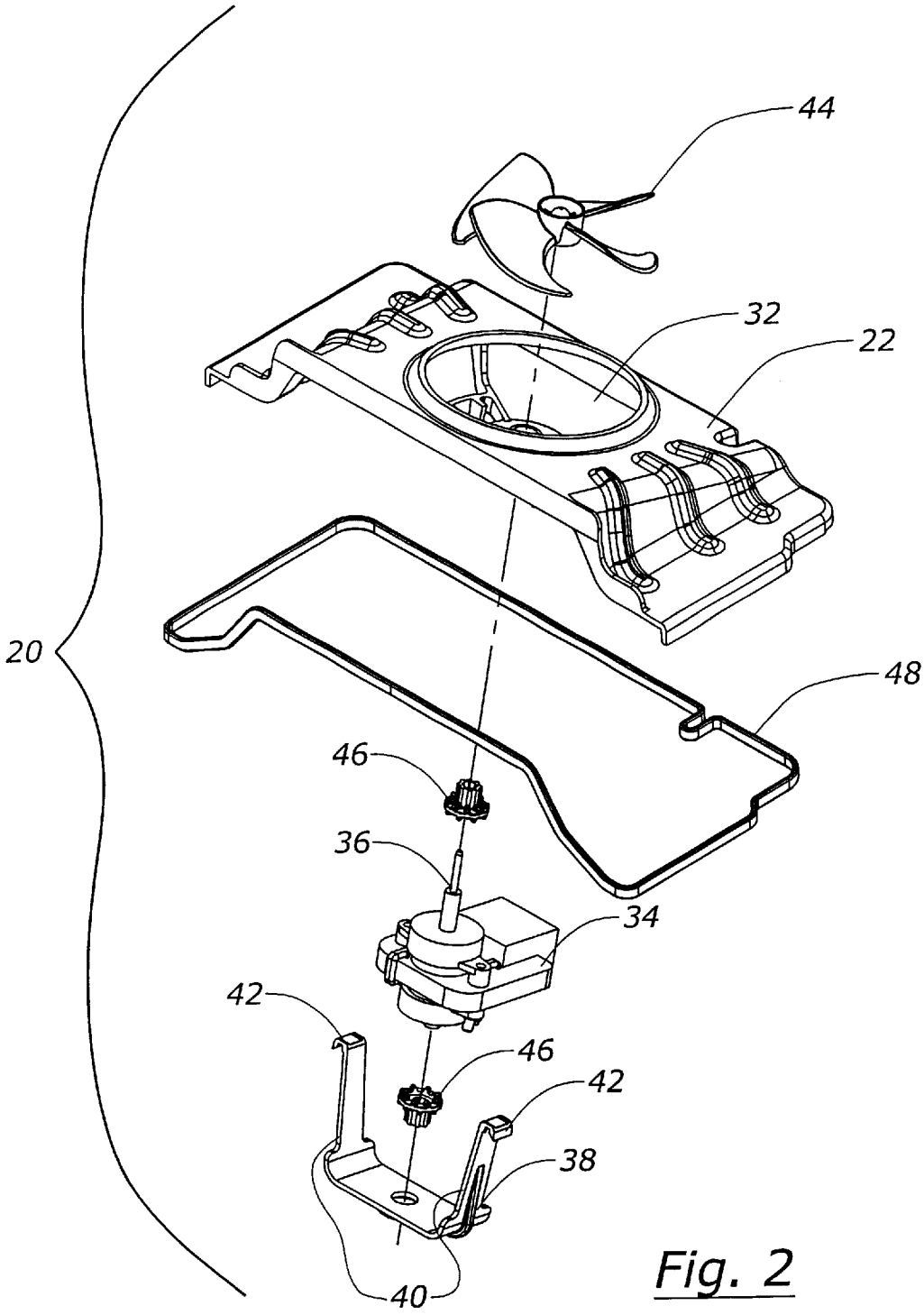
FIG. 2 is an exploded view of one embodiment of the evaporator fan assembly of the present invention.

The evaporator fan assembly 20 of the present invention generally includes a shroud 22, a motor 34 and a fan 44 as shown in FIG. 2. Preferably, the shroud 22 is formed or molded from a plastic material as is commonly known in the art. As is better shown in FIG. 3, the shroud 22 of the present invention generally includes a plurality of motor supports or shroud legs 24 that surround a fan orifice 32. The shroud legs 24 are generally angled down and away from the top of the orifice 32 and terminate in a motor positioning piece or motor mount 26. The motor mount 26 preferably includes a hole 30 through which the motor drive shaft 36 and a rubber grommet 46 will be inserted.

The shroud legs 24 are also preferably irregularly staggered and radially outwardly spaced about the fan orifice 32, as shown. By placing the shroud legs 24 away from the edge of the fan orifice 32 (radially outwardly spacing them) and irregularly staggering the shroud legs 24, noise caused by a buildup of aerodynamic forces created during normal fan operation can be minimized.

Figure 3:
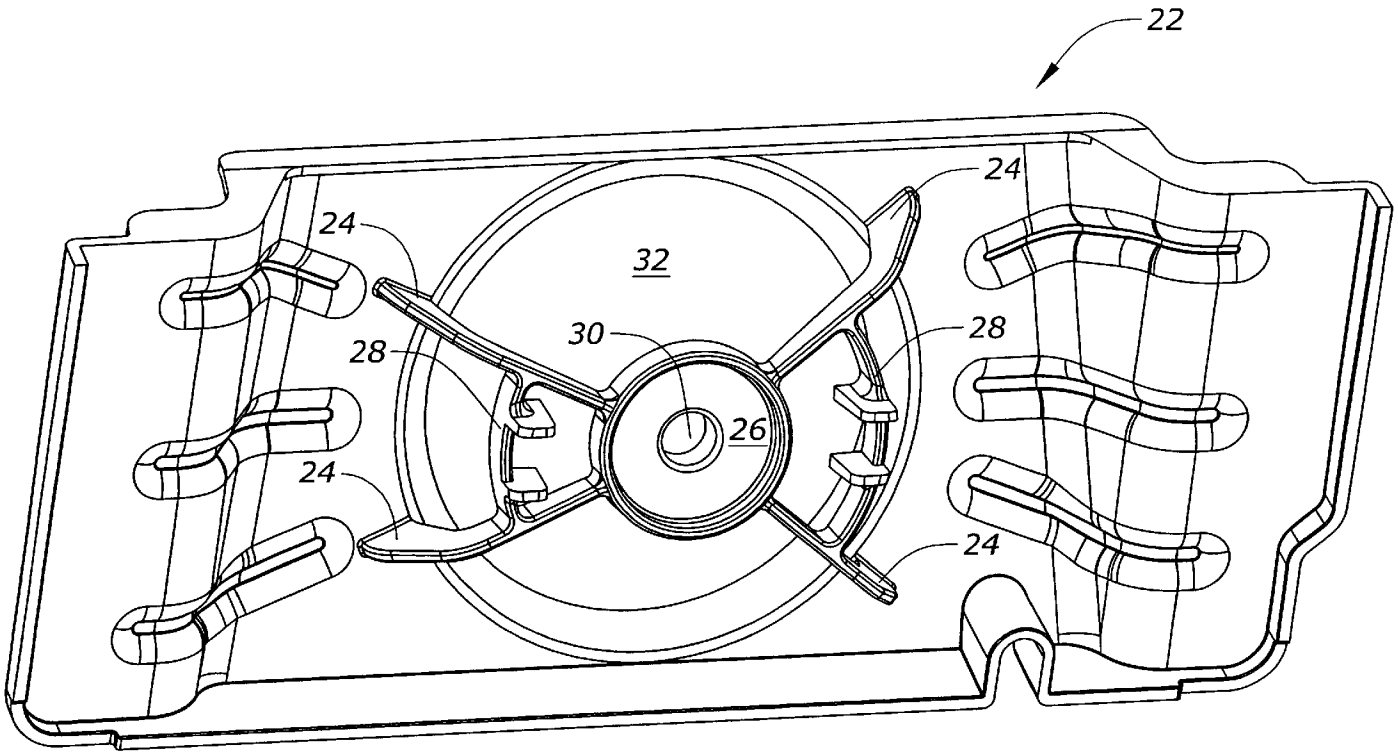
FIG. 3 is an underside view of one embodiment of the shroud of the present invention.

When four shroud legs 24 are used as shown in FIG. 3, at least two of the shroud legs 24 are more than 90° apart. When any other number of shroud legs 24 are employed, at least one of the shroud legs 24 should be separated from another shroud leg 24 by an angle greater than $$\frac{360}{N}$$

degrees where N is the total number of shroud legs. Thus, the shroud legs 24 will be irregularly staggered about the fan orifice 32 and noise levels of the fan will be minimized.

In between the shroud legs 24, one or more cross members or supporting bars 28 may be provided. The cross members or supporting bars 28 stiffen the shroud legs 24 and provide an area on which to secure the motor 34. The motor 34 is secured to the shroud legs 24 by a motor clip 38.

Generally, the motor clip 38 includes a pair of legs 40 secured to or molded in conjunction with a base 41. The base 41 includes a hole 43 to properly center the motor 34 during mounting. Each of the legs 40 terminate in a hook or catch 42. The motor clip 38 is preferably a single piece of molded plastic.

Figure 4:
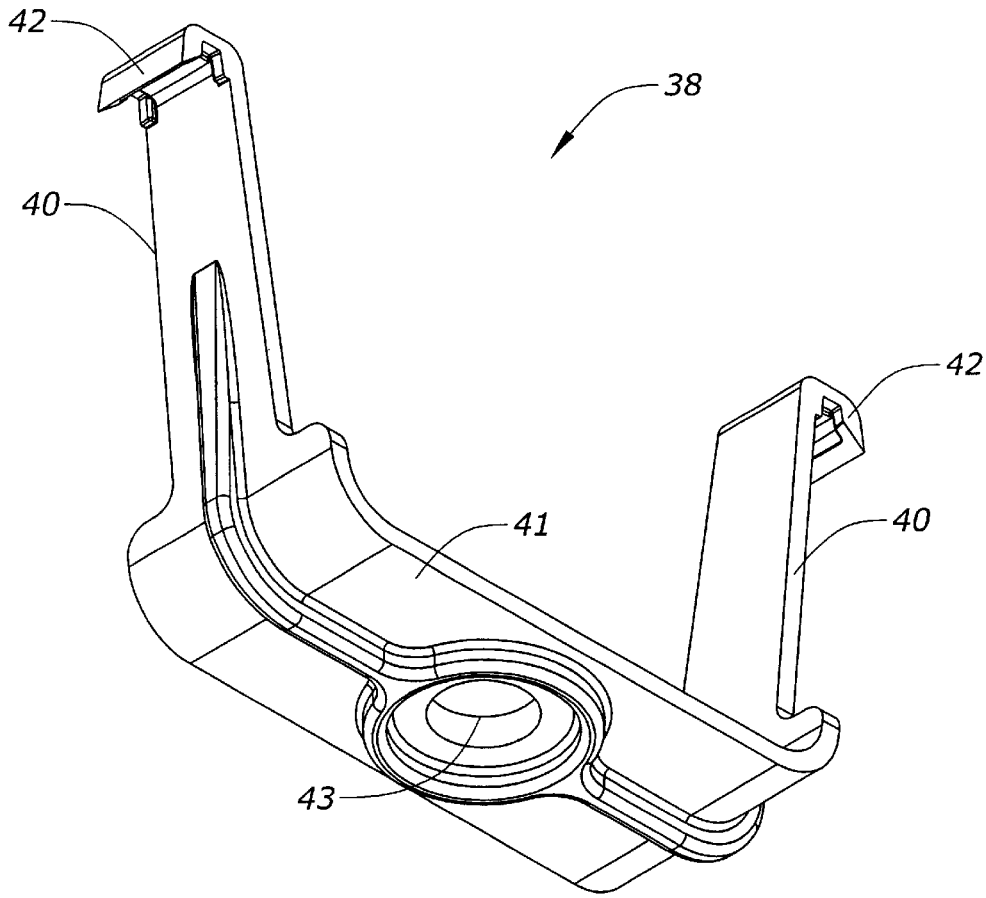
FIG. 4 is a perspective view of one embodiment of the motor clip of the present invention.

During installation, the motor 34 is placed on top of a rubber grommet 46 and into the hole 43 in the motor clip 38. After the motor clip 38 is placed over the motor 34, the installer squeezes the legs 40 of the motor clip 38 to fit between the cross members 28 on the shroud 22. When released, the catches or hooks 42 on the legs 40 of the motor clip 38 secure the motor 34 in proper position. In this manner, the motor 34 and the motor clip 38, shown in FIG. 4, are snap-fit to the cross members 28. The cross members 28 may include a plurality of moldings to prevent the motor clip 38 from moving side to side as shown. In proper position, the motor drive shaft 36 is centered and extends through the hole 30 in the motor mount 26 such that the fan 44 is properly centered in the fan orifice 32. The fan 44 may be glued, screwed on, pressure fit or otherwise secured to the motor drive shaft 36.

The entire fan assembly 20 is then inserted and secured to the refrigerator/freezer 10 as shown in FIG. 1. If necessary, a gasket 48, shown in FIG. 2, may be secured to the shroud 22 in a manner to properly seal the shroud 22 when installed. The shroud 22 may be secured to the refrigerator/freezer 10 in any known manner, including screws, snaps, nails, glue, pressure fitting or any other known means.

Figure 5:
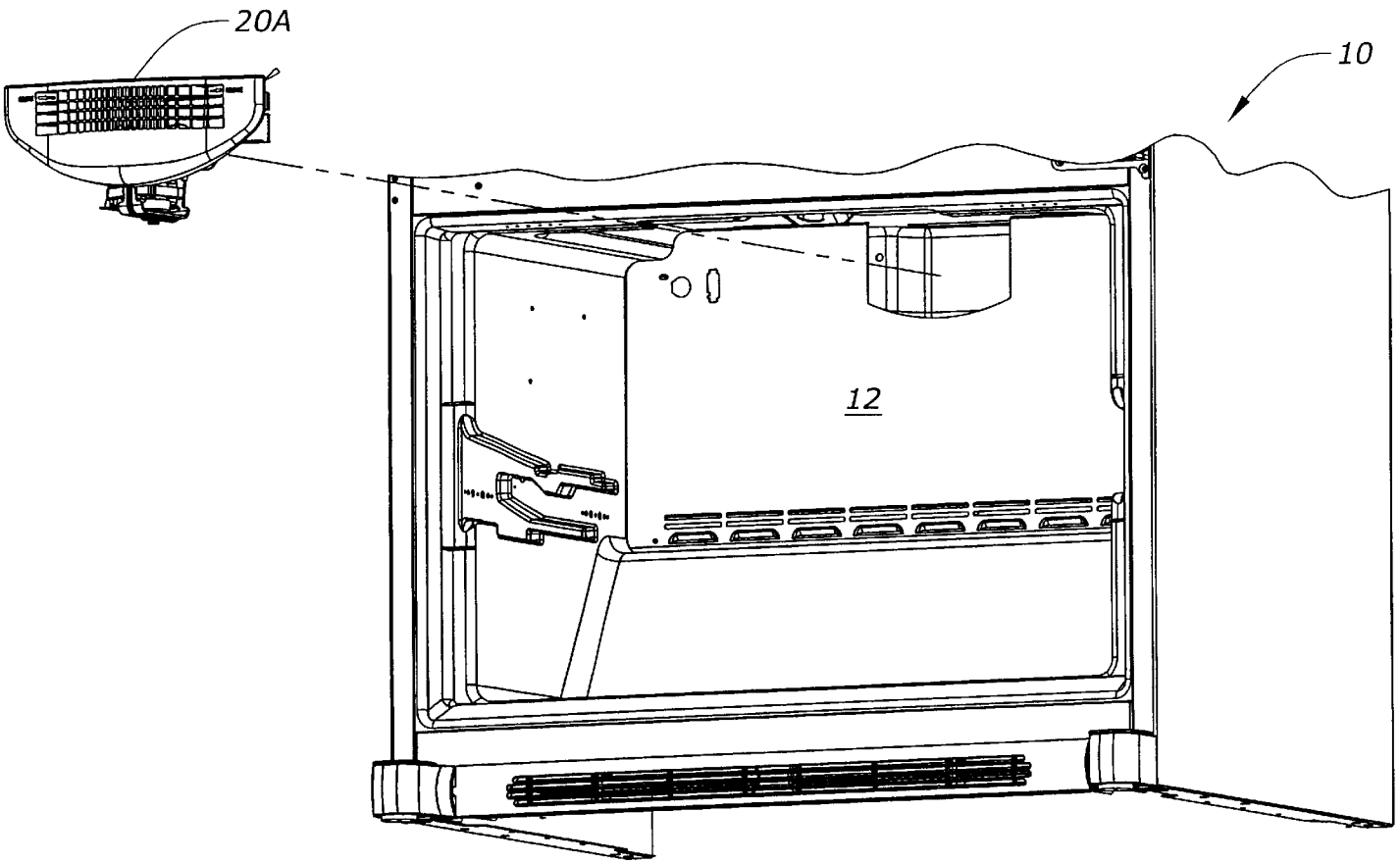
FIG. 5 is a sectional view of another embodiment of the present invention in a stacked refrigerator/freezer assembly.
Figure 6:
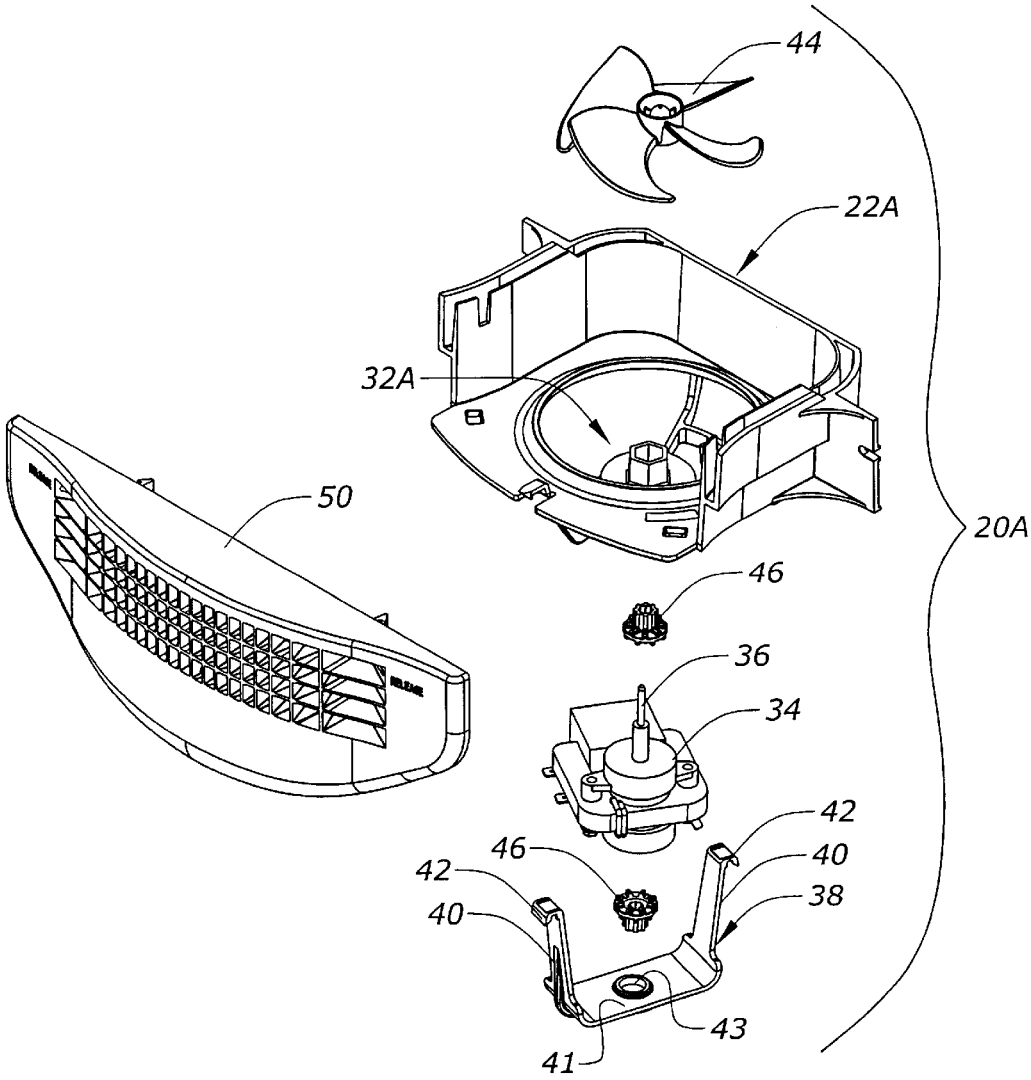
FIG. 6 is an exploded view of the embodiment of the present invention shown in FIG. 5.

An alternative embodiment is shown in FIG. 5. As shown, the evaporator fan assembly 20A is preferably installed in a stacked-style refrigerator/freezer unit 10. As can be seen in FIG. 6, the alternative embodiment of the evaporator fan assembly 20A may include a shroud cover 50 secured to the shroud 22A. The shroud cover 50 may include a plurality of vanes and is preferably molded from a plastic material similar to that used to produce the shroud.

Figure 7:
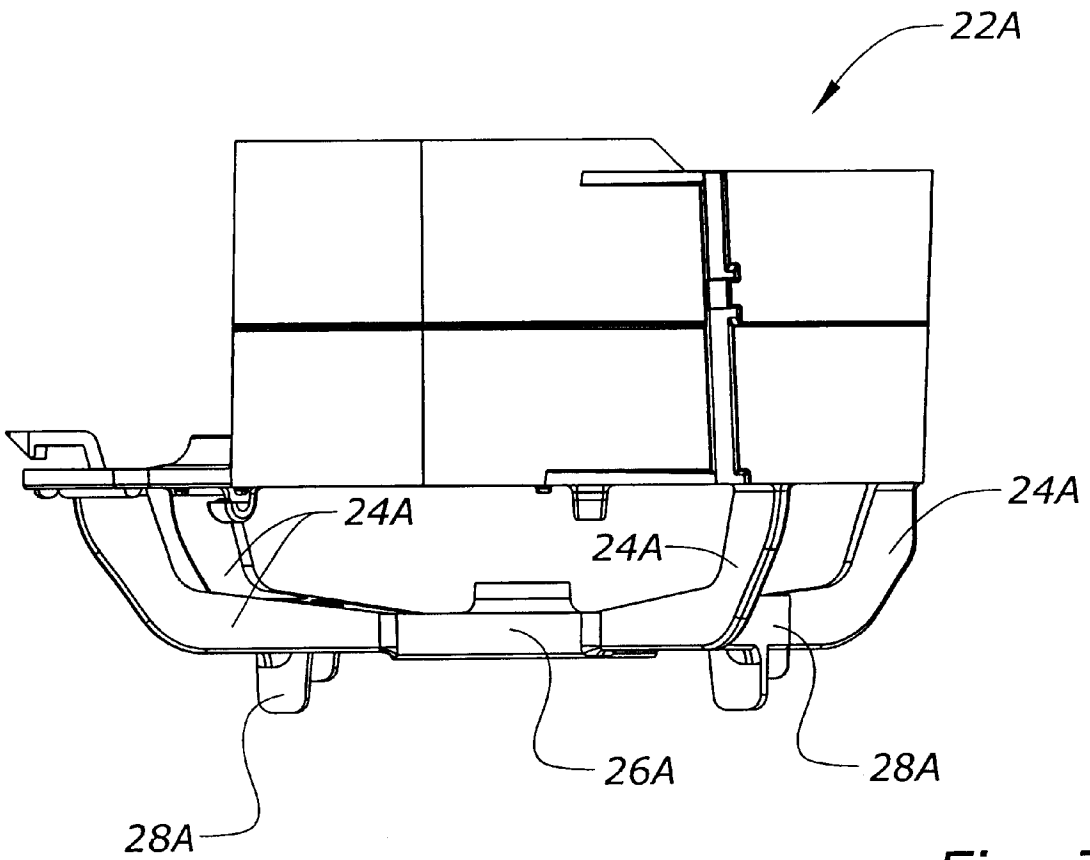
FIG. 7 is a side view of the embodiment of the shroud shown in FIGS. 5 and 6.
Figure 8:
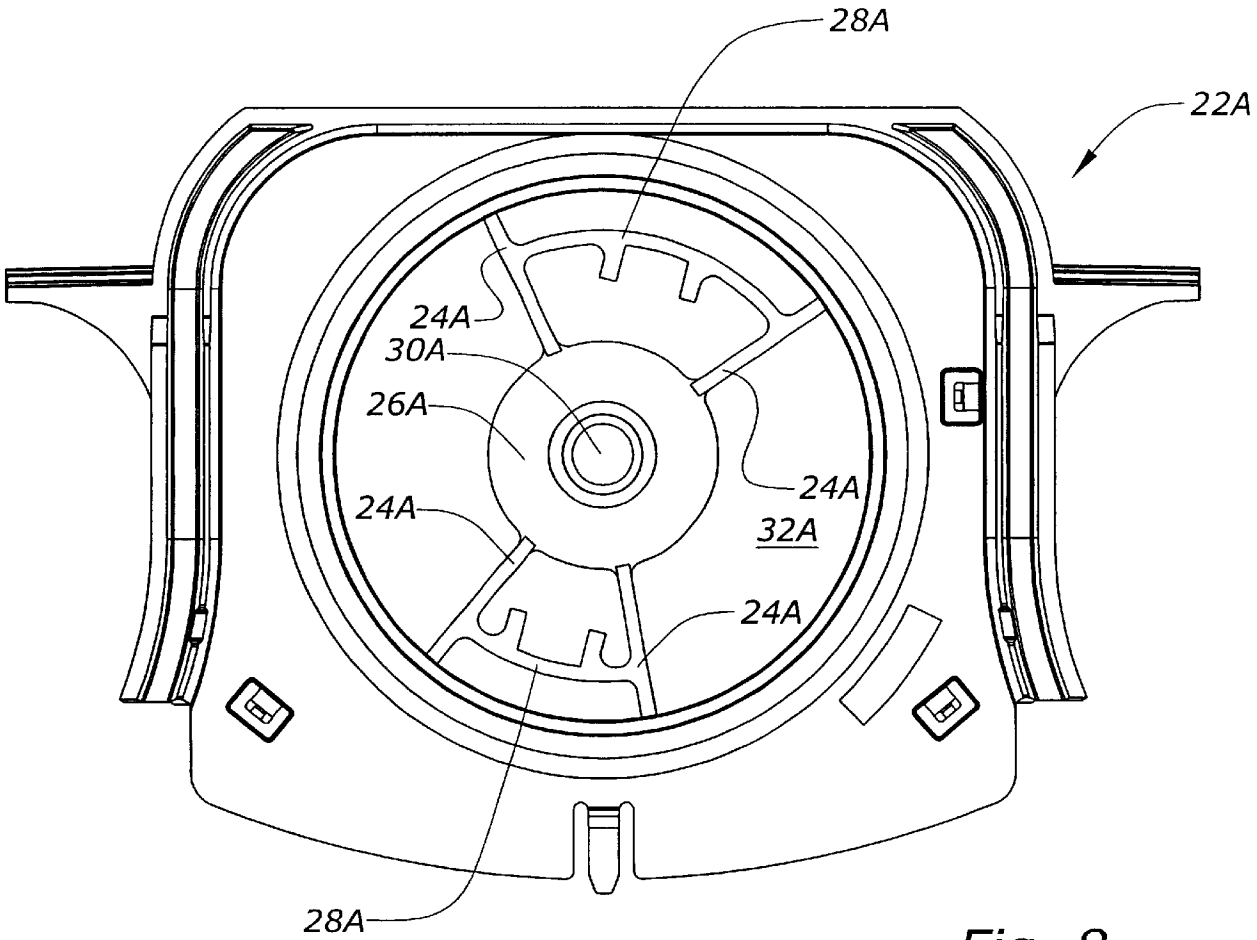
FIG. 8 is a bottom view of the shroud of FIGS. 5–7.

As is shown in FIG. 7, the legs 24A of the present invention extend below and away from the top of the shroud 22A. The motor mount 26A preferably disposed in a centered location beneath the fan orifice 32A as shown in FIG. 8.

Whereas the invention has been shown and described in connection with the preferred embodiments thereof, it will be understood that many modifications, substitutions, and additions may be made which are within the intended broad scope of the following claims.

What is claimed is:

1. An evaporator fan assembly for a refrigeration unit comprising:

a shroud having a front side land a rear side and a fan orifice;

a motor mourn spaced from the shroud;

a plurality of shroud legs extending between and connected to the shroud and the motor mount in an irregularly staggered and radially outwardly spaced arrangement about the fan orifice;

a motor; and a motor clip including one or more legs adapted to connect to the shroud legs to removably secure the motor between the motor clip and the motor mount.

2. The evaporator fan assembly of claim 1 wherein the motor includes a drive shaft, the motor being positioned on the motor mount so the motor drive shaft extends into the fan orifice.

3. The evaporator fan assembly of claim 1, the evaporator fan assembly further comprising a shroud cover.

4. The evaporator fan assembly of claim 1 wherein the motor clip and motor mount center the motor relative to the fan orifice.

5. The evaporator fan assembly of claim 2 wherein the drive shaft passes through a hole in the motor mount.

6. The evaporator fan assembly of claim 1 further comprising a fan blade operatively secured within the fan orifice.

7. The evaporator fan assembly of claim 1 further comprising support bars secured between the legs and wherein the motor clip is snap fit to the support bars.

8. The evaporator fan assembly of claim 1 wherein the shroud legs include a first end secured to the rear side of the shroud and a second end positioned inwardly from the first end and away from the fan orifice.

9. A method of removably mounting an evaporator motor and fan in a refrigerator, the method comprising:

mounting a shroud assembly to the refrigerator, the shroud including a fan orifice, a motor mount and a plurality of legs irregularly staggered and radially outwardly spaced about the fan orifice, the legs extending between and connected to the fan orifice and the motor mount;

removably securing a motor to the motor mount by placing a motor clip over the motor and snapping the motor clip to the legs; and operatively securing a fan to the motor so as to reside in the fan orifice.

10. The method of claim 9 further comprising securing a shroud cover to the shroud.

11. The method of claim 9 further comprising placing grommets on the motor before placing the motor on the motor clip.

12. An improved refrigerator/freezer comprising:

a housing defining a refrigerator/freezer chamber;

a plastic shroud mounted in the housing and including a fan orifice and a plurality of legs irregularly staggered and radially outwardly spaced about the fan orifice;

a motor removably secured to the legs in a snap-fit manner; and a fan secured to the motor and residing in the fan orifice of the shroud.

13.The refrigerator/freezer of claim 12 further comprising a motor clip for securing the motor to the legs.

14. The refrigerator/freezer of claim 12 wherein the shroud assembly further comprises a shroud cover.

15. The refrigerator/freezer of claim 12 further comprising a grommet between the motor and the plastic shroud.

16. The refrigerator/freezer of claim 12 further comprising a gasket secured around the plastic shroud.

* * * * *